US007959119B2

(12) United States Patent
Tusting et al.

(10) Patent No.: US 7,959,119 B2
(45) Date of Patent: Jun. 14, 2011

(54) PROTECTION DEVICE STEM DESIGN

(75) Inventors: Paul Tusting, Salt Lake City, UT (US); Jonathan Woodward, Salt Lake City, UT (US); Bill Belcourt, Salt Lake City, UT (US); Joe Skrivan, Draper, UT (US); Dave Mellon, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 0 days.

(21) Appl. No.: 12/247,661

(22) Filed: Oct. 8, 2008

(65) Prior Publication Data

US 2009/0045307 A1 Feb. 19, 2009

Related U.S. Application Data

(62) Division of application No. 11/021,000, filed on Dec. 22, 2004.

(51) Int. Cl.
*A47F 5/08* (2006.01)

(52) U.S. Cl. ..... 248/231.9; 248/925; 248/231.91; 248/694; 294/94; 294/95; 294/96; 294/28; 294/106; 294/19.1; 294/100

(58) Field of Classification Search ..... 248/925, 248/231.9, 231.91, 694; 294/94, 95, 96, 294/128, 106, 19.1, 100
See application file for complete search history.

(56) References Cited

U.S. PATENT DOCUMENTS

| | | | | |
|---|---|---|---|---|
| 2,903,291 | A | | 9/1959 | Barthule |
| 2,979,297 | A | | 4/1961 | Suozzo |
| 2,985,480 | A | | 5/1961 | Otley |
| 3,371,663 | A | | 3/1968 | Apgar |
| RE26,704 | E | | 11/1969 | Norton |
| 3,592,502 | A | | 7/1971 | Bolliger |
| 3,776,585 | A | | 12/1973 | Bridgehouse |
| 3,877,679 | A | | 4/1975 | Lowe |
| 4,044,976 | A | | 8/1977 | Campbell |
| 4,184,657 | A | * | 1/1980 | Jardine ..... 248/231.9 |
| 4,526,164 | A | | 7/1985 | Bihl |
| 4,565,342 | A | | 1/1986 | Grow |
| 4,566,342 | A | | 1/1986 | Kurz |
| 4,572,464 | A | | 2/1986 | Phillips |

(Continued)

FOREIGN PATENT DOCUMENTS

AT 398167 10/1994

(Continued)

*Primary Examiner* — Nkeisha J Smith
(74) *Attorney, Agent, or Firm* — Trent Baker; Baker & Associates PLLC

(57) ABSTRACT

The present invention relates to a connection system for use with an active or passive protection device that minimizes weight. In accordance with the present invention, a single stem connection system for use with an active protection device includes a single bent cable that is attached to the single cable terminal of the active protection device. A stem tube is fitted over a portion of the bent cable giving the appearance and benefits of a single stem. However, a portion of the bent cable is left separated thereby automatically forming a clip-in point for the entire active protection device. Unlike conventional single stem connection systems, the single stem system in accordance with the present invention only requires coupling the cable to the cable terminal thereby reducing manufacturing cost and minimizing overall weight. Alternatively, a similar connection system can be used with a passive protection device to provide many of the same benefits.

16 Claims, 9 Drawing Sheets

U.S. PATENT DOCUMENTS

| | | | | |
|---|---|---|---|---|
| 4,575,032 | A | 3/1986 | Taylor | |
| 4,643,377 | A | 2/1987 | Christianson | |
| 4,643,378 | A | 2/1987 | Guthrie et al. | |
| 4,645,149 | A | 2/1987 | Lowe | |
| 4,781,346 | A | 11/1988 | Banner | |
| 4,832,239 | A | 5/1989 | Andersson | |
| 4,832,289 | A * | 5/1989 | Waggoner | 248/231.9 |
| 4,923,160 | A * | 5/1990 | Waggoner | 248/200 |
| 5,617,767 | A * | 4/1997 | Nikoden | 81/488 |
| 5,860,629 | A * | 1/1999 | Reed | 248/231.9 |
| 6,042,069 | A * | 3/2000 | Christianson | 248/231.9 |
| 6,119,993 | A | 9/2000 | Youngblood et al. | |
| 6,375,139 | B1 * | 4/2002 | Murray et al. | 248/231.9 |
| 6,679,466 | B2 * | 1/2004 | Brown | 248/231.9 |
| 6,736,359 | B2 * | 5/2004 | Murray | 248/231.9 |
| 7,014,156 | B2 * | 3/2006 | Apezetxea et al. | 248/231.9 |
| 7,040,588 | B2 * | 5/2006 | Lowe | 248/231.9 |
| 2003/0057337 | A1 * | 3/2003 | Brown | 248/231.9 |
| 2004/0035992 | A1 * | 2/2004 | Watts | 248/231.9 |
| 2005/0037023 | A1 | 2/2005 | Field, Jr. | |
| 2005/0218282 | A1 | 10/2005 | Phillips | |
| 2006/0231708 | A1 * | 10/2006 | Robertson et al. | 248/231.9 |

FOREIGN PATENT DOCUMENTS

| | | |
|---|---|---|
| DE | 3517741 | 1/1986 |
| GB | 2369068 | 5/2002 |
| GB | 2380949 | 4/2003 |

* cited by examiner

PROTECTION DEVICE STEM DESIGN

RELATED APPLICATIONS

This patent application is a divisional patent application of U.S. patent application Ser. No. 11/021,000, which was filed on Dec. 22, 2004, and which is presently pending before the United States Patent and Trademark Office. Priority is hereby claimed to all material disclosed in this pending parent case.

This application claims priority to U.S. Provisional Application Ser. No. 60/538,406 filed Jan. 22, 2004, entitled "PROTECTION DEVICE STEM DESIGN".

TECHNICAL FIELD

The present invention relates to active and passive protection devices and more particularly to the stem of an active or passive protection device.

BACKGROUND

Climbers generally use clean protection devices for two distinct purposes. First, a clean protection device may be used as a form of safety protection for protecting a climber in the event of a fall and second, a clean protection device may intentionally be used to artificially support a climber's weight. Clean protection devices cam or wedge into a crack, hole, gap, orifice, taper, or recess in order to support an outward force. The area or surface within which the clean protection device supports the outward force is considered the protection surface. The protection surface can consist of natural materials such as rock or may consist of artificial materials such as concrete.

Clean protection devices are generally divided into active and passive categories. Passive protection devices include a single object, which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable objects that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection devices is camming devices. These devices translate rotational displacement into linear displacement. Therefore, a slider chock would not be an active camming device because the two wedges simply slide relative to one another and do not rotate. Camming devices include two, three, and four cam lobe devices. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

Active protection devices are generally preferable to passive protection devices because of their ability to cam into a variety of features. For example, a standard four-cam unit has a particular camming range that allows it to cam into features within a particular size range. Whereas, a passive protection device is limited to a single shape and can therefore only cam or wedge into features that conform to that particular shape. Unfortunately, the largest disadvantage of active protection devices is their considerable weight in relation to passive protection devices. One of the heavier components of an active protection device is the connection system. The connection system connects the camming objects to some form of clip-in point. The two most common connection systems used in three and four cam units are single stem and double stem systems. Double stem systems include a U-shaped cable that attaches independently to two cable terminals on either end of the head of the protection device. The clip-in point of a double stem system is simply the bottom of the U-shaped cable. Single stem systems include a single cable that is attached to a single cable terminal located at the center of the head of the protection device. The single stem system generally includes some form of clip-in loop attached to the single cable. Alternatively, a clip-in loop can be created by coupling the single cable back to itself with some form of swage. Single stem connection systems are generally preferable for larger cams because they are less likely to obstruct particular camming placements.

SUMMARY

Existing single stem connection systems for use with active protection devices possess many limitations. One of the main problems associated with conventional single stem systems is their weight. Weight is an extremely important factor in climbing equipment because any unnecessary weight requires a climber to expend additional energy in making upward progress up a particular climb. In addition, climbers must often carry their protection devices long distances before a climb begins causing the climber to expel even more energy if a protection device includes unnecessary weight. Alternatively, if a particular protection device is perceived to include unnecessary weight a climber is unlikely to use it. From a business standpoint, climbers are unlikely to purchase protection devices that are perceived to possess unnecessary weight. Therefore, there is a need in the industry for a single stem connection system compatible with active protection devices that minimizes weight but maintains the existing benefits.

In addition, a second problem associated with conventional single stem systems is their high manufacturing costs. Single stem systems are generally more expensive to manufacture than double stem systems because of the additional clip-in loop that must be attached to the stem. As discussed above, conventional single stem systems do not automatically possess a clip-in point. Therefore, a clip-in point or loop must be connected to the single stem or created by coupling the single stem back to itself. The clip-in point or loop is generally a metal or plastic piece that must be independently manufactured. The connection between the clip-in point and the single stem or the single stem and itself must also be performed as part of the assembly process. These additional steps and parts unnecessarily raise the manufacturing cost of producing single stem systems. Therefore, there is a need in the industry for a single stem system that is less expensive to manufacture but maintains the benefits of existing single stem systems.

The present invention relates to a connection system for use with an active or passive protection device that minimizes weight. In accordance with the present invention, a single stem connection system for use with an active protection device includes a single bent cable that is attached to the single cable terminal of the active protection device. A stem tube is fitted over a portion of the bent cable giving the appearance and benefits of a single stem. However, a portion of the bent cable is left separated thereby automatically forming a clip-in point for the entire active protection device. Unlike conventional single stem connection systems, the single stem system in accordance with the present invention only requires coupling the cable to the cable terminal thereby reducing manufacturing cost and minimizing overall weight. Alternatively, a similar connection system can be used with a passive protection device to provide many of the same benefits.

In one embodiment, the connection system includes coupling the cable to the cable terminal by extending the two ends of the cable through a single hole in the cable terminal and then coupling the ends of the cable to a ball wedge. The ball wedge is shaped in a substantially conical manner that prevents the ball wedge from extending back down through the cable terminal.

In an alternative embodiment, the single cable terminal is actually two independent cable terminals adjacent to one another. The two ends of the cable are then independently coupled to each of the two cable terminals.

In yet another alternative embodiment, the cable terminal includes a lower member within which the cable is coupled. Therefore, rather than extending the cable through a recess between the axle holes of the cable terminal, the cable is coupled to the cable terminal at the lower member.

In yet another alternative embodiment, the cable is coupled directly to the cable terminal. The cable is extended through a hole or recess between the axle holes and is then directly coupled to the cable terminal with a coupling technique such as compression swaging.

In yet another alternative embodiment, a terminal member is used that integrates both a cable terminal and an axle into one member. The terminal member is coupled to the cable either internally or externally as described in the other embodiments. Because the axle is integrated with the cable terminal it is not necessary to provide axle holes.

In yet another alternative embodiment, the cable is coupled to a camming head to form a passive protection device. The two ends of the cable are extended into the camming head through a single hole or recess. The ends of the cable are directly coupled to the camming head or externally coupled by coupling to a member such as a ball wedge.

The embodiments described above may also be combined in any manner to create additional embodiments. The foregoing and other features, utilities, and advantages of the invention will be apparent from the following detailed description of the invention with reference to the accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

The present invention relates to a connection system for use with an active or passive protection device that minimizes weight. In accordance with the present invention, a single stem connection system for use with an active protection device includes a single bent cable that is attached to the single cable terminal of the active protection device. A stem tube is fitted over a portion of the bent cable giving the appearance and benefits of a single stem. However, a portion of the bent cable is left separated thereby automatically forming a clip-in point for the entire active protection device. Unlike conventional single stem connection systems, the single stem system in accordance with the present invention only requires coupling the cable to the cable terminal thereby reducing manufacturing cost and minimizing overall weight. Alternatively, a similar connection system can be used with a passive protection device to provide many of the same benefits. Also, while embodiments of the present invention are described in the context of a connection system for use with a protection device, and a method of manufacturing, it will be appreciated that the teachings of the present invention are applicable to other applications as well.

Figure 1:
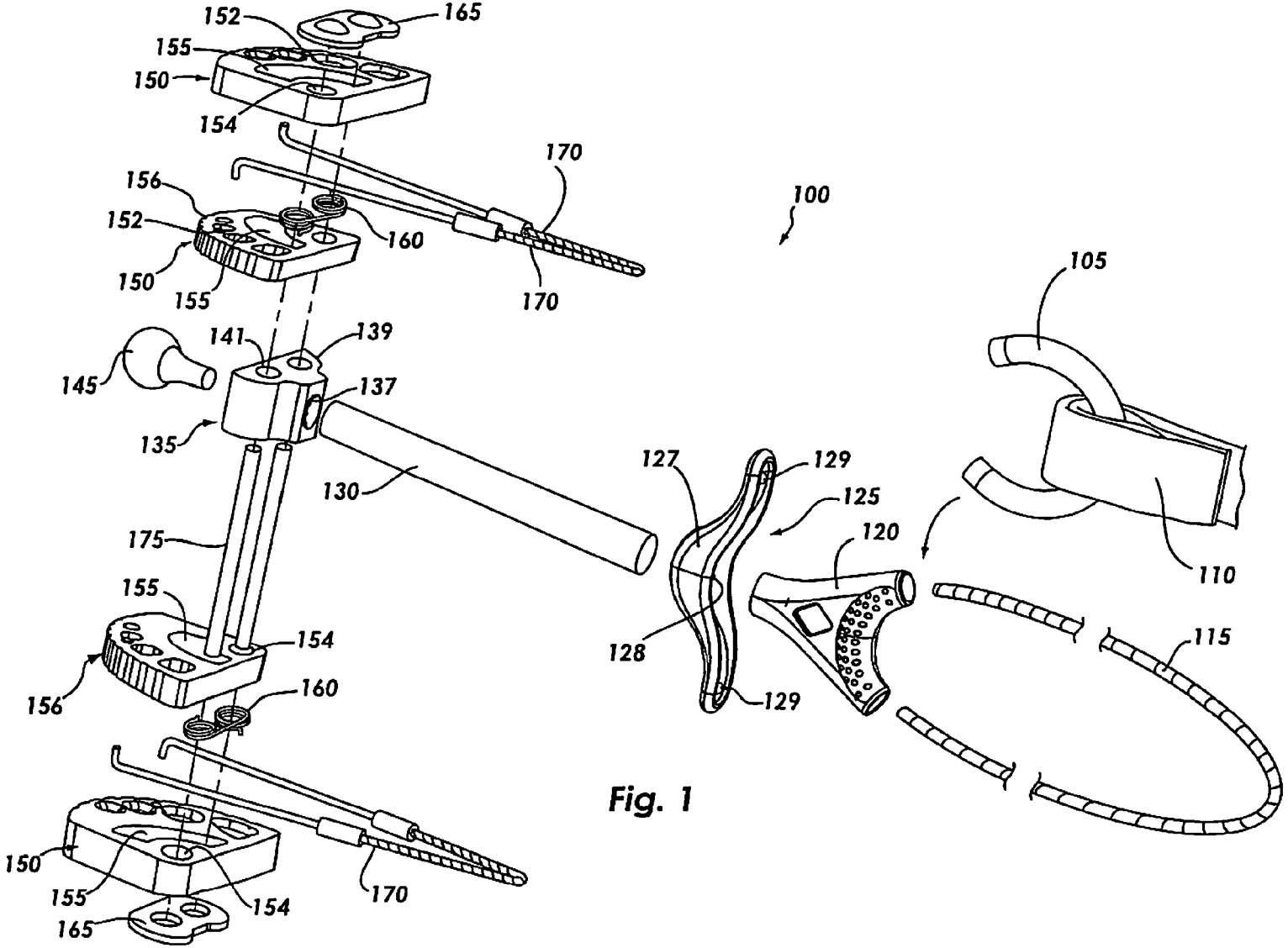
FIG. 1 illustrates an exploded view of a dual axle, four-cam unit, including one embodiment of a connection system according to the present invention.

Reference is initially made to FIG. 1, which illustrates an exploded view of a dual axle, four-cam unit, including one embodiment of a connection system according to the present invention. The active protection device illustrated in FIG. 1 is designated generally at 100. The active protection device includes a camming system, a retraction system, and a connection system. The illustrated camming system includes four cam lobes 150, two axles 175, two torsion springs 160, a cable terminal 135, and two axle connectors 165. The camming system is configured to actively cam against a protection surface. The middle of the axles 175 are positioned substantially within the two holes 141 of the cable terminal 135. The cam lobes 150, torsion springs 160, and axle connectors 165 are positioned on either side of the two axles 175 as shown in FIG. 1. Two of the cam lobes are coupled to one axle 175 while the other two cam lobes 150 are coupled to the other axle. A cable terminal or terminal is defined broadly to include any means for coupling the axle and or the cam lobes to the stem portion of the device. The cam lobes 150 each include a fixed axle hole 154, an open axle area 155, a trigger hole 152, and a body 156. The torsion springs 160 are each coupled to a single cam lobe 150 and an adjacent torsion spring 160 as shown in FIG. 1. This configuration results in biasing the cam lobes 150 in an extended position. The cam lobes 150 are prevented from over rotating through the use of the dual axle design and more specifically the open axle areas 155 abutting against the axles 175. Alternatively, if the active protection device 100 utilizes a single axle design, cam stops would need to be included on the cam lobes to prevent them from over-rotating. The axle connectors 165 are positioned on the outer edges of the axles 175 to prevent the cam lobes 150 from sliding off the axles 175. Alternatively, compression springs, extension springs, leaf springs, or a compliant mechanism could be used to bias the cam lobes 150 in the extended position. Although the illustrated embodiment shows two axles 175, it should be noted that the teachings of the present invention can be utilized with any number of axles and remain consistent with the present invention.

The retraction system includes the various components to retract the cam lobes 150 into a retracted position. The retraction system includes a trigger 125 and four trigger wires 170. The trigger 125 further includes two trigger wire holes 129, a stem hole 128, and a body 127. The trigger 125 is configured to be slidable with respect to the stem such that a user can retract the trigger away from the cable terminal 135. The trigger 125 is independently coupled to each of the cam lobes 150 via the trigger wires 170. The trigger wires 170 hook into the trigger holes 152 in the cam lobes 150 and the trigger wire holes 129 on the trigger 125. The distance between the trigger and the cable terminal 135 must be precisely measured in order to maintain proper retraction ergonomics while minimizing overall device weight. For example, if the distance between the trigger 125 and cable terminal 135 is too short, it is possible for the cam lobes 150 to touch or rub a user's hand during retraction. Likewise, if the distance between the trigger 125 and the cable terminal 135 is too long, the device includes unnecessary weight. Therefore, the trigger 125 must be optimally positioned a particular distance from the cable terminal 135. However, by swooping or bending the body 127 of the trigger 125, as shown in FIGS. 1-3, the trigger 125 can be positioned even closer to the cable terminal 135 without risking contact between a user's hand and the cam lobes 150 during retraction.

The connection system is designed to provide a system by which a user can connect the camming system to a rope or other device. The connection system in accordance with the embodiment illustrated in FIG. 1 includes a single cable terminal 135, a stem tube 130, a thumb rest 120, a cable cover 105, a cable 115, and a connection sling 110. Although the illustrated embodiments show the cable 115 being oriented parallel to the axle, it should be noted that the cable could be oriented perpendicular or in any other orientation with respect to the axle and remain consistent with the present invention. The connection system of the present invention is unique in that it creates the appearance of a single stem and automatically forms a clip-in point for a user. In addition, the illustrated connection system minimizes the amount of connections or swages by using a single cable 115 and a single terminal 135. The cable 115 extends through the cable cover 105 at a median point on the cable 115 which will form the clip-in point. The cable cover 105 prevents external devices from contacting the cable 115. A connection sling 110 is also coupled to the cable cover 105 to provide an auxiliary clip-in point. Alternatively, the connection sling 110 could be doubled around the cable cover 105, as described in more detail with reference to FIG. 9, to increases the force necessary to cut the connection sling 105 on the cable cover 105 and cable 115. In addition, different webbing materials may also be used for the connection sling 110 to increase the force necessary to cut the connection sling 105 on the cable cover 105 and the cable 115. The cable 115 extends through the thumb rest 120 and stem tube 130 as shown in FIG. 1. The stem tube 130 compresses the two halves of the wire up against one another giving the appearance of a single stem. The thumb rest 120 assists in transitioning the cable 115 from the separated or clip-in portion to the compressed or single-stem portion. The thumb rest 120 also provides a location for a user to apply an opposing force when retracting the trigger 125. The ends of the cable 115 that extend through the stem tube 130 are extended through cable hole 137 in the cable terminal 135 and coupled to the ball wedge 145 at a single connection point. The ball wedge 145 is shaped in a substantially conical configuration to prevent being extended back through the cable hole 137 of the cable terminal 135. The coupling between the cable 115 and the ball wedge 145 includes but is not limited to a compression swage or a heated solder coupling. Alternatively, other embodiments of a connection system in accordance with the present invention are described with reference to FIGS. 4-7.

The connection system illustrated in FIG. 1 has many benefits over those found in conventional active protection devices. Minimizing the cable's 115 gauge or thickness and the number of cable 115 connections or couplings effectively minimize the overall weight of the connection system. Conventional single stem connection systems utilize a heavier gauge wire and multiple wire connection points. The thickness or gauge of the wire and the number of connection points dramatically affects the overall weight of an active protection device. Likewise, dual stem active protection devices include multiple cable terminals and therefore multiple cable connection points also resulting in additional weight.

Figure 2:
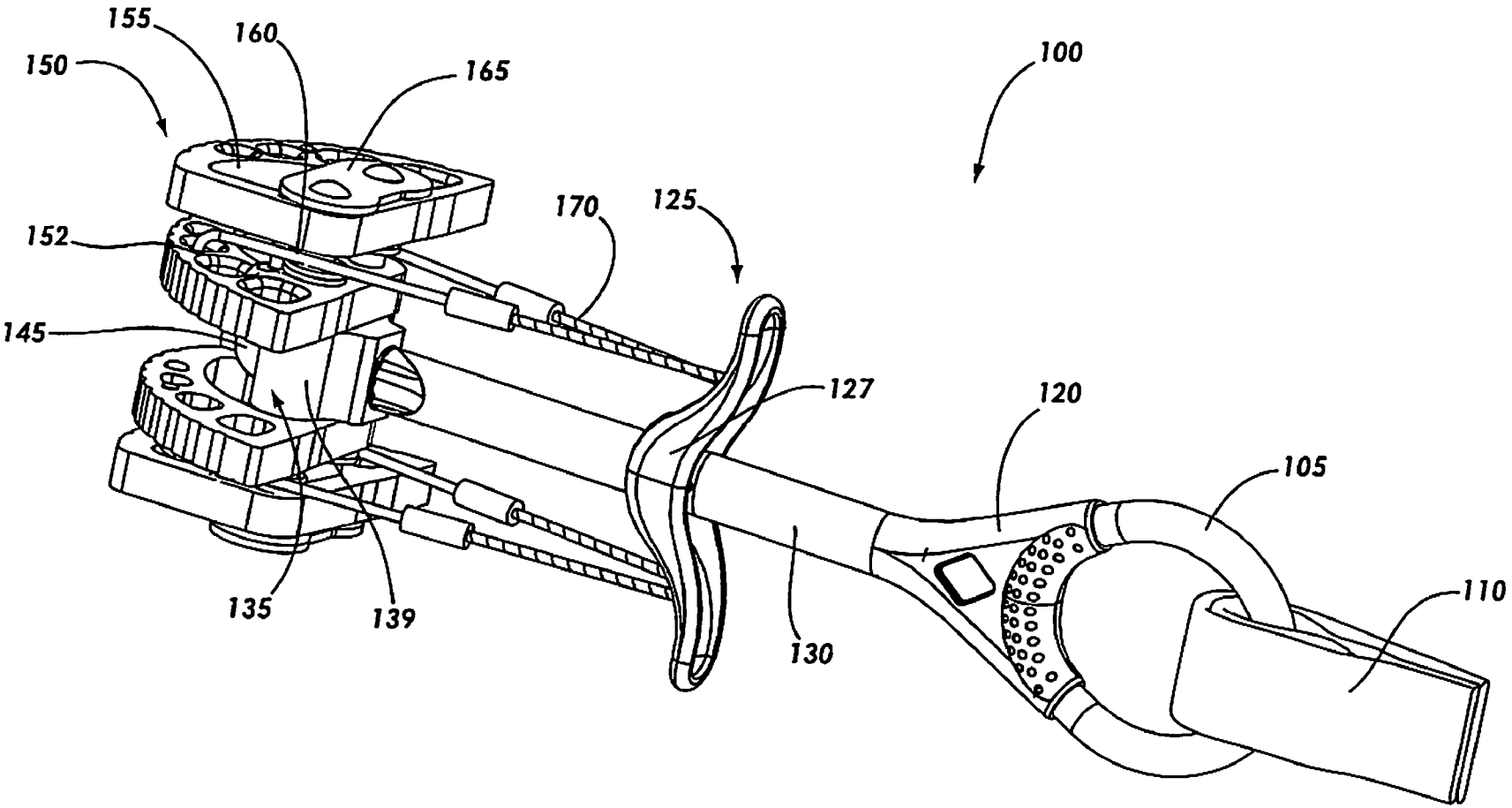
FIG. 2 illustrates a perspective view of the dual axle, four-cam unit shown in FIG. 1 in an expanded configuration.
Figure 3:
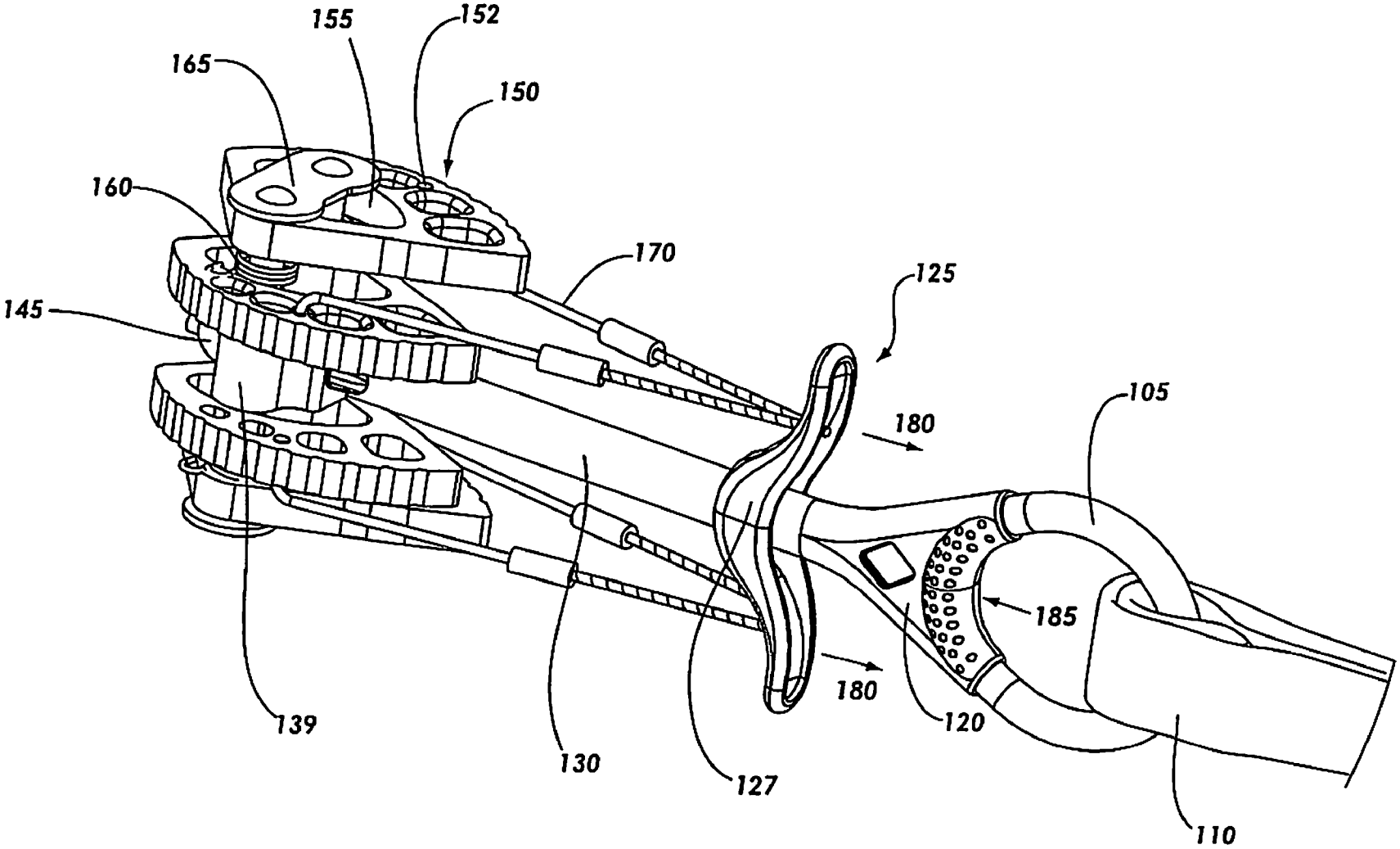
FIG. 3 illustrates a perspective view of the dual axle, four-cam unit shown in FIG. 1 in a retracted configuration.

Reference is next made to FIGS. 2 and 3, which illustrate perspective views of the dual axle, four-cam unit shown in FIG. 1 in an expanded and retracted configurations respectively. As discussed above, the cam lobes 150 can be positioned in either an expanded or retracted position. The expanded position shown in FIG. 2 results from no force being applied to the trigger 125 thereby allowing the torsion springs to bias the cam lobes 150 into the extended position. When a retraction force 180 is applied to the trigger 125 and a stabilizing force 180 is applied to the thumb rest, the cam lobes 150 are retracted into the retracted position as shown in FIG. 3. The retraction force 180 applied to the trigger 125 causes the trigger wires 170 to retract or rotate the cam lobes 150 as shown. As soon as the retraction force 180 is released from the trigger 125, the torsion springs 160 will cause the cam lobes 150 to automatically return to the expanded configuration shown in FIG. 2.

Figure 4:
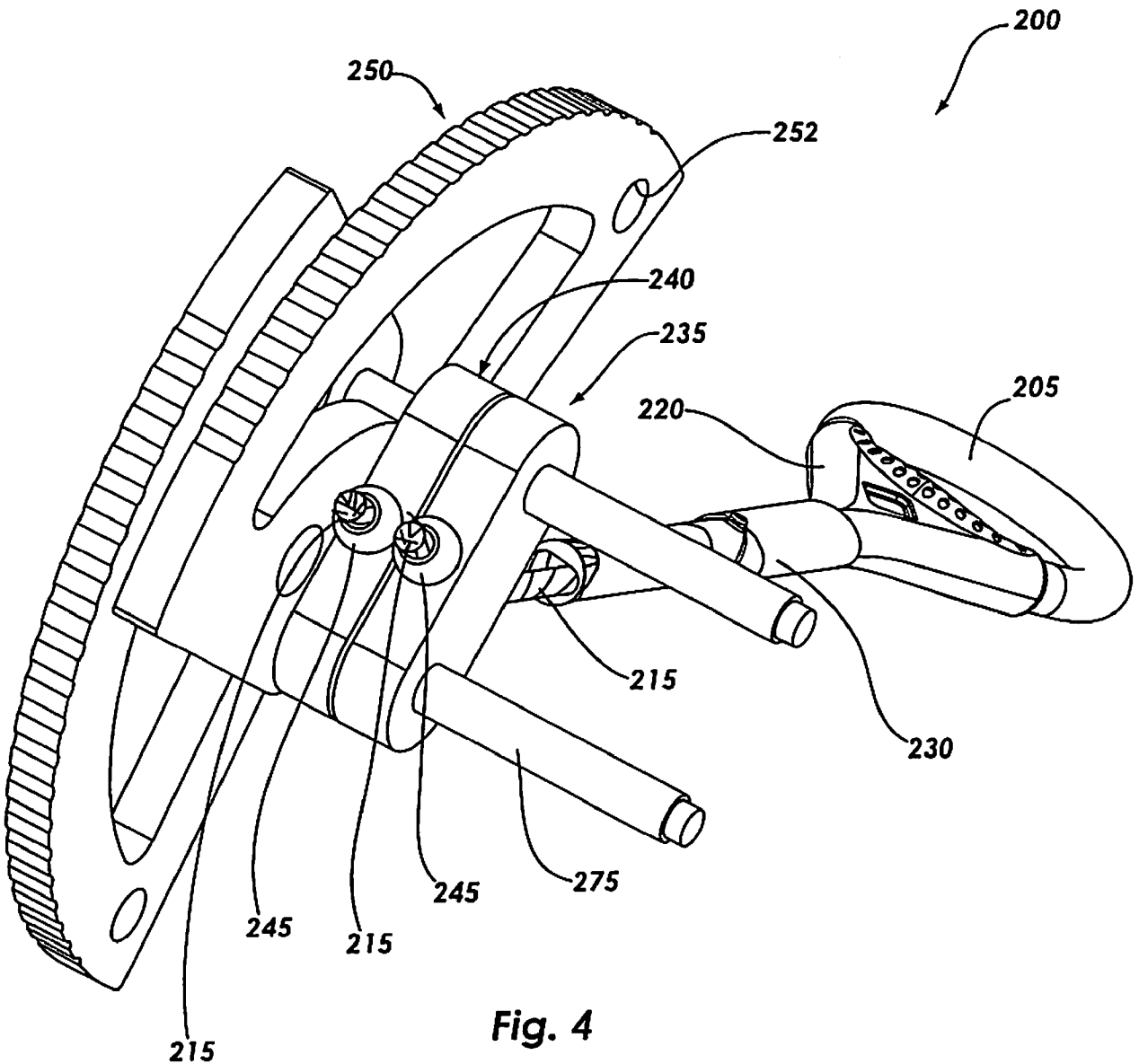
FIG. 4 illustrates a perspective view of an alternative embodiment of a connection system according to the present invention wherein the connection system includes two adjacent terminals.

Reference is next made to FIG. 4, which illustrates an alternative embodiment of a connection system according to the present invention wherein the connection system includes two adjacent terminals. The active protection device 200 illustrated in FIG. 4 is incomplete for the purpose of illustrating an alternative connection system in accordance with the present invention. The alternative connection system includes a cable 215, a stem tube 230, a thumb rest 220, a cable cover 205, and two cable terminals 235, 240. The two cable terminals 235, 240 are positioned adjacent and substantially coupled to one another as shown in FIG. 4. The cable 215 is extended through the cable cover 205, thumb rest 220, and stem tube 230 in the same manner as described with reference to the connection system illustrated in FIG. 1. The two individual ends of the cable 215 are then independently coupled to each of the cable terminals 235, 240. Although FIG. 4 illustrates coupling the ends of the cable 215 to a ball wedge 245 beyond each of the cable terminals 235, 240, it will be appreciated that other cable 215 to cable terminal 235, 240 coupling systems may be used and remain consistent with the present invention.

Figure 5:
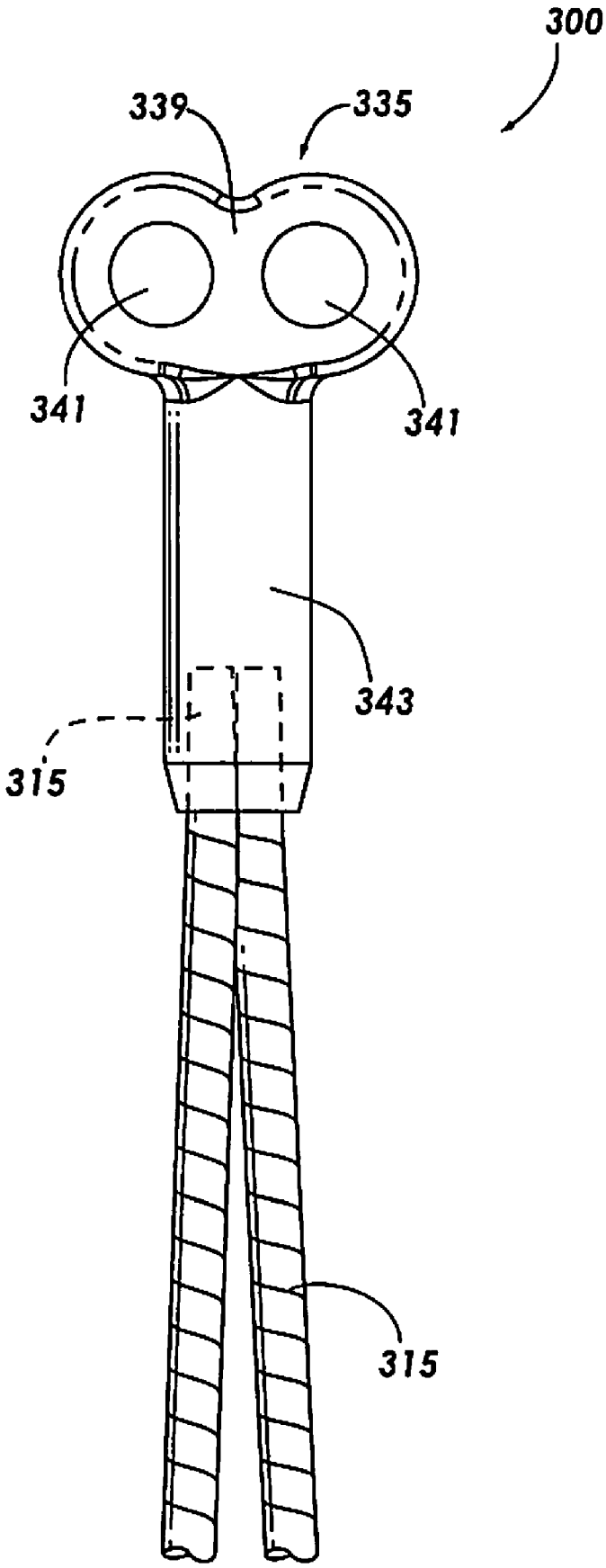
FIG. 5 illustrates a perspective view of yet another alternative embodiment of a cable terminal according to the present invention wherein the cable terminal includes a lower member.

Reference is next made to FIG. 5, which illustrates yet another alternative embodiment of a cable terminal according to the present invention wherein the cable terminal includes a lower member. The cable terminal 300 illustrated in FIG. 5 is only a portion of a connection system but is configured such that it could be substituted into the active protection device 100 illustrated in FIG. 1. The cable terminal 335 includes a top portion 339, two axle holes 341, and a lower member 343. Unlike the embodiments described with reference to FIGS. 1-4, the cable 315 only extends into the lower member 343 of the cable terminal 300 as shown in phantom. The cable 315 is coupled to the lower member 343 with a coupling system including but not limited to swaging or soldering. This embodiment may be particularly useful for very small active protection devices wherein the necessary spacing between the axle holes 341 does not allow for the cable 315 to be extended all the way through the cable terminal 335.

Figure 6:
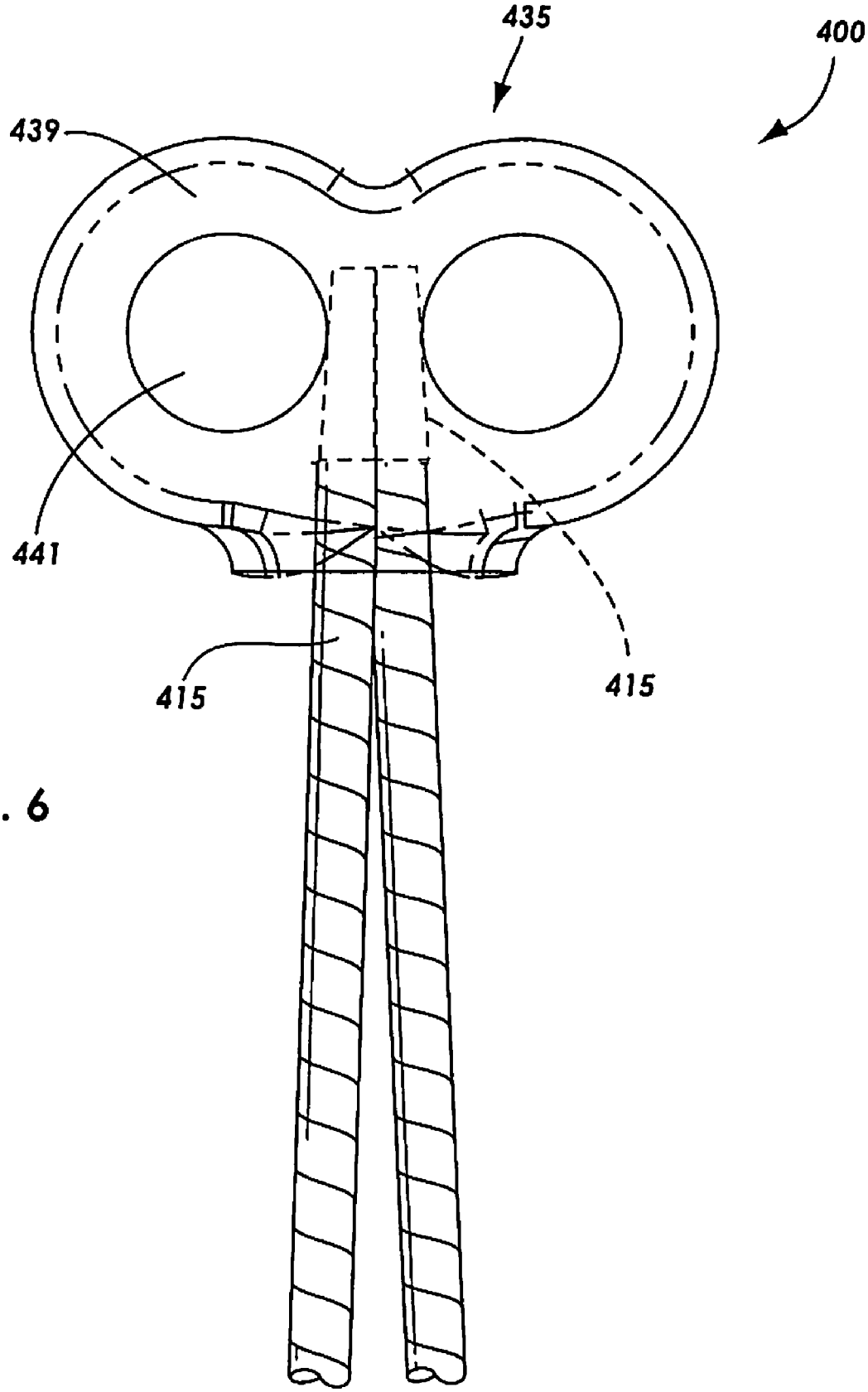
FIG. 6 illustrates a perspective view of yet another alternative embodiment of a cable terminal according to the present invention wherein the cable is configured to attach to the cable terminal through a single hole.

Reference is next made to FIG. 6, which illustrates yet another alternative embodiment of a cable terminal according to the present invention wherein the cable is configured to attach to the cable terminal through a single hole. The cable terminal 400 illustrated in FIG. 6 is only a portion of a connection system but is configured such that it could be substituted into the active protection device 100 illustrated in FIG. 1. The cable terminal 435 includes a body 439 and two axle holes 441. The cable 415 is able to extend all the way through the cable terminal 435 similar to the embodiment shown in FIGS. 1-3. However, the ends of the cable 415 are swaged directly to the cable terminal 435 rather than to a ball wedge. This embodiment is particularly useful for large active camming units where there is sufficient space between the axle holes 441 to extend the cable 415 between the axles holes 441 and swage it to the cable terminal 435.

Figure 7:
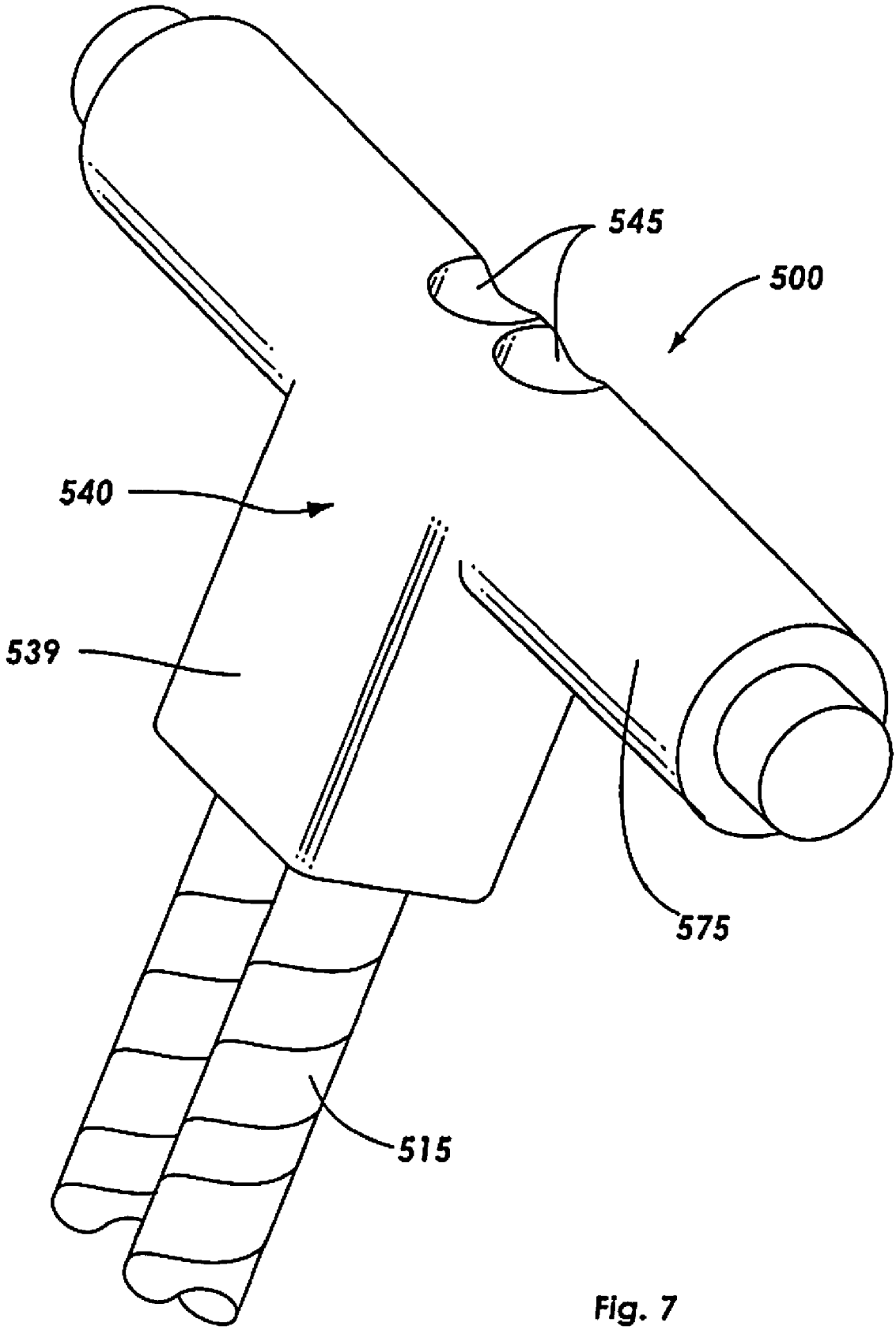
FIG. 7 illustrates a perspective view of yet another alternative embodiment of a terminal member according to the present invention wherein a terminal member includes an integrated cable terminal and axle.

Reference is next made to FIG. 7, which illustrates yet another alternative embodiment of a terminal member according to the present invention wherein a terminal member includes an integrated cable terminal and axle. The terminal member 500 illustrated in FIG. 7 is only a portion of a connection system but is configured such that it could be substituted into a single axle active protection device. The terminal member 500 includes an axle portion 575 disposed on the outer portion and a terminal portion 540 disposed on the middle portion of the terminal member 500. The terminal portion includes a cable terminal 539 and two cable receiving holes 545. The cable 515 is coupled to the terminal member 500 either directly (as discussed with reference to FIG. 6) or externally (as discussed with reference to FIGS. 1-4). In addition, the axle portion 575 can be configured to conform to the size requirements necessary to accommodate any type of cam lobe. The terminal member 500 embodiment illustrated in FIG. 7 is particularly useful for small single axle active protection devices.

Figure 8:
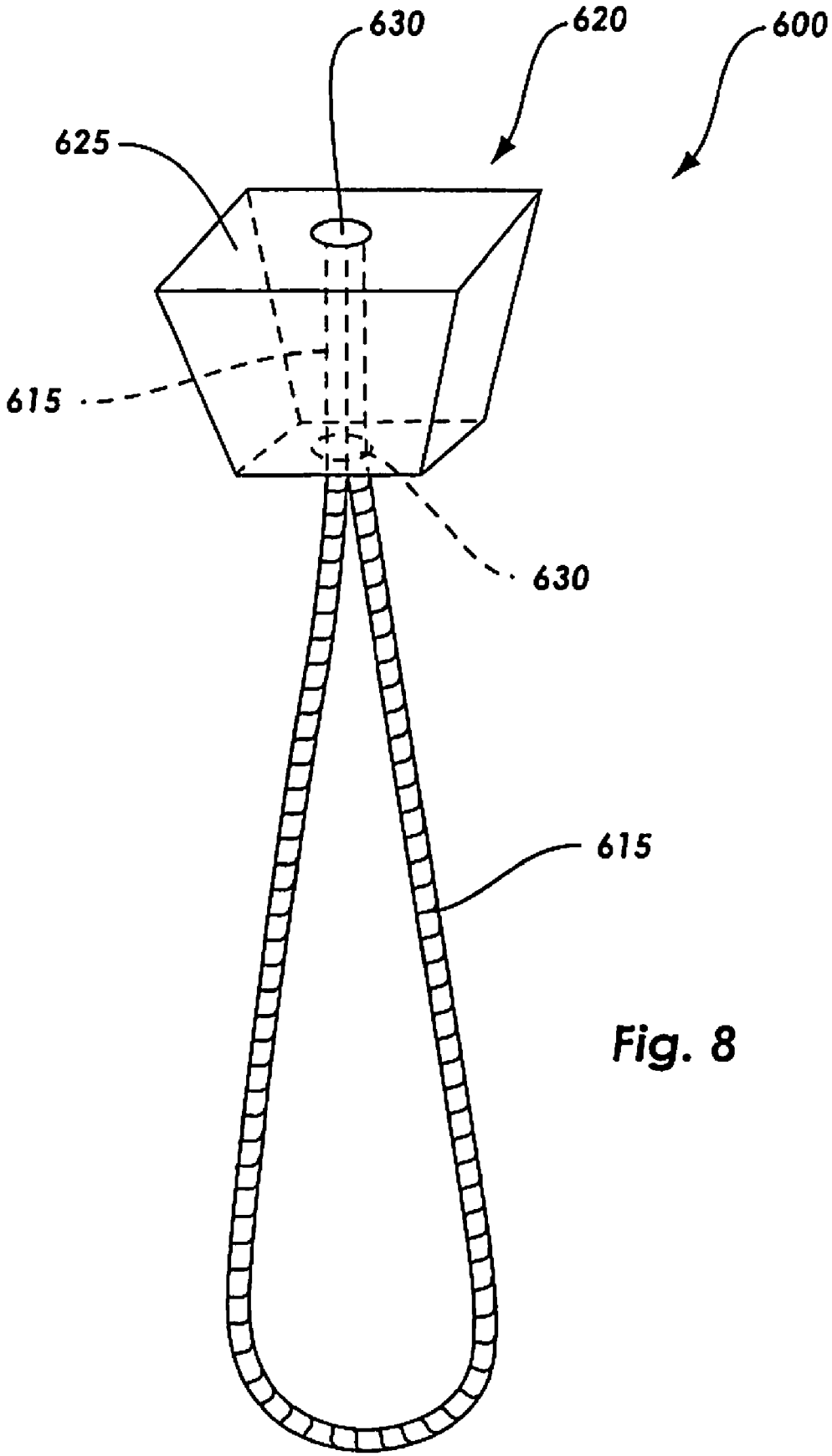
FIG. 8 illustrates a passive protection device incorporating a connection system according to the present invention.

Reference is next made to FIG. 8, which illustrates a passive protection device incorporating a connection system according to the present invention. The passive protection device 600 illustrated in FIG. 8 is a standard wedge chock but the connection system in accordance with the present invention could be used with any type of passive protection device. The passive protection device 600 includes a camming head 620 and a cable 615. The camming head 620 is shaped and tapered to passively cam into one or more particularly sized tapers. The camming head includes a body 625 and a recess 630 that extends through the body 625. The cable 615 is coupled to the camming head 620 by extending into the single recess 630 and directly coupling to the camming head 620. The coupling technique between the camming head 620 and the cable 615 includes but is not limited to swaging or soldering. Alternatively, the cable 615 could extend through the camming head 620 and be coupled to an external member such as a ball wedge.

Figure 9:
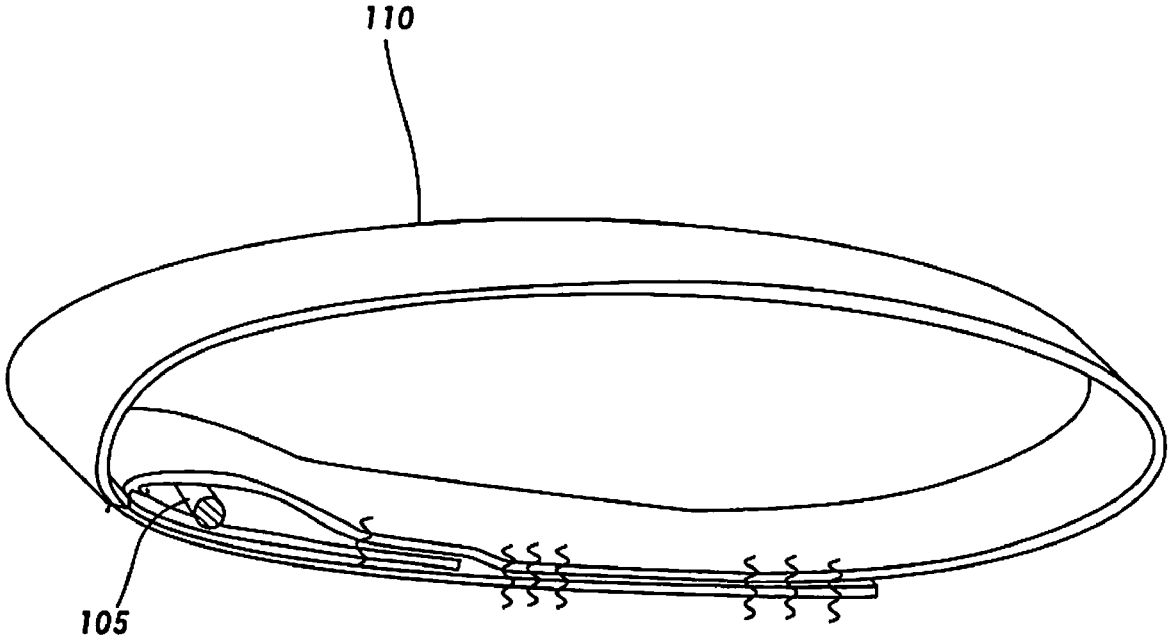
FIG. 9 illustrates an alternative embodiment of a sling for use with an active camming device.

Reference is next made to FIG. 9, which illustrates an alternative embodiment of a sling 110 for use with an active camming device. The illustrated sling 110 configuration increases the force required for the cable 115 to cut through the sling. The area around the cable 115 is effectively doubled. In addition, the stitching configuration of the sling allows for the entire length of the sling to be usable rather than a portion. Likewise, the stitching configuration naturally biases the sling in an open position allowing for easy clipping and grabbing. These are significant advantages over the prior art double sling configurations.

While this invention has been described with reference to certain specific embodiments and examples, it will be recognized by those skilled in the art that many variations are possible without departing from the scope and spirit of this invention. For example, the teachings of one embodiment may be combined with the teachings of another and remain consistent with the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. A single stem active protection device comprising:

an axle;

a terminal having a first side and a second side, wherein a middle of the axle is coupled to the terminal between the first and second side of the terminal;

a plurality of opposing cam lobes coupled to the axle, wherein the terminal is disposed between at least two of the plurality of opposing cam lobes;

a refraction system coupled to the plurality of opposing cam lobes; and a connection system attached to the terminal, wherein the connection system includes a cable having two ends and wherein the two ends are immovably coupled to the terminal, and wherein the connection system includes a thumb rest member configured to transition the cable from a separated region to a parallel region, and wherein the thumb rest member includes a thumb location at the separated region between two portions of the cable, and wherein the thumb location corresponds to an internal separation of the cable, and wherein the thumb location includes an internal separation angle of greater than 90 degrees between the two portions of the cable.

2. The single stem active protection device of claim 1, wherein the immovable coupling between the terminal and the two ends is immovable in all directions.

3. The single stem active protection device of claim 1, wherein the first side is substantially parallel to the second side of the terminal.

4. The single stem active protection device of claim 1, wherein the axle includes a first axle and a second axle and wherein two of the plurality of opposing cam lobes are coupled to the first axle and two other opposing cam lobes are coupled to the second axle, and wherein the cable is lengthwise translationally immovable with respect to the terminal, cam lobes, and axles.

5. The single stem active protection device of claim 1, wherein the retraction system includes:

a plurality of torsion springs coupled to the axle and the plurality of opposing cam lobes; and a triggering system coupled to the plurality of opposing cam lobes.

6. The triggering system of claim 5, wherein the triggering system includes a trigger shaped in a laterally curved manner to minimize the necessary distance of the trigger from the cam lobes while ensuring that the cam lobes do not contact a user's hand during a retraction process.

7. The single stem active protection device of claim 1, wherein the retraction system includes:

a triggering system coupled to the plurality of opposing cam lobes; and a plurality of compression springs coupled to the triggering system and the connection system.

8. The triggering system of claim 7, wherein the triggering system includes a trigger shaped in a laterally curved manner to minimize the necessary distance of the trigger from the cam lobes while ensuring that the cam lobes do not contact a user's hand during a retraction process.

9. The single stem active protection device of claim 1, wherein the retraction system includes:

a plurality of extension springs coupled to the axle and the plurality of opposing cam lobes; and a triggering system coupled to the plurality of opposing cam lobes.

10. The triggering system of claim 9, wherein the triggering system includes a trigger shaped in a laterally curved manner to minimize the necessary distance of the trigger from the cam lobes while ensuring that the cam lobes do not contact a user's hand during a retraction process.

11. The single stem active protection device of claim 1, wherein a middle portion of the cable is routed through a stem tube that is coupled to the terminal such that a loop of cable is formed opposite the terminal.

12. The single stem active protection device of claim 1, wherein the two ends of the cable are coupled to the terminal by swaging into at least one recess in a lower member of the terminal.

13. The single stem active protection device of claim 1, wherein the connection system further includes a doubled sling stitched in configuration to allow use of a full length of the sling and such that the sling is biased into an open position.

14. A single stem active protection device comprising:

a terminal member having a first side and a second side, wherein a middle portion of the terminal member is a terminal portion and an outer portion of the terminal member is an axle portion;

a plurality of opposing cam lobes coupled to the terminal member, wherein the terminal portion is disposed between at least two of the plurality of opposing cam lobes;

a refraction system coupled to the plurality of opposing cam lobes; and a connection system attached to the terminal portion, wherein the connection system includes a cable having two ends and wherein the two ends are immovably coupled to the terminal portion, and wherein the connection system includes a thumb rest member configured to transition the cable from a separated region to a parallel region, and wherein the thumb rest member includes a thumb location at the separated region between two portions of the cable, and wherein the thumb location corresponds to an internal separation of the cable, and wherein the thumb location includes an internal separation angle of greater than 90 degrees between the two portions of the cable.

15. A single stem active protection device comprising:

an axle;

a terminal having a first side and a second side, wherein a middle of the axle is coupled to the terminal between the first and second side of the terminal;

a plurality of opposing cam lobes coupled to the axle, wherein the terminal is disposed between at least two of the plurality of opposing cam lobes;

a refraction system coupled to the plurality of opposing cam lobes; and a connection system attached to the terminal, wherein the connection system includes a single elongated member that is folded and stitched to itself in a loop configuration that biases toward an open loop position and substantially doubles the shear strength of a single stitched looped sling, and wherein the connection system includes a cable having two ends immovably coupled to the terminal, and wherein the loop configuration of the single elongated member further includes a primary enclosed region and a secondary enclosed region, and wherein the secondary enclosed region is enclosed within the primary enclosed region, and wherein the cable is enclosed within the secondary enclosed region, and wherein the connection system includes a thumb rest member configured to transition the cable from a separated region to a parallel region, and wherein the thumb rest member includes a thumb location at the separated region between two portions of the cable, and wherein the thumb location corresponds to an internal separation of the cable, and wherein the thumb location includes an internal separation angle of greater than 90 degrees between the two portions of the cable.

16. The single stem active protection device of claim 15, wherein the single elongated member further includes:

an inner sling loop;

an outer sling loop that surrounds the inner sling loop; and a plurality of stitches, wherein the plurality of stitches bias the outer sling loop in an open position.

* * * * *

UNITED STATES PATENT AND TRADEMARK OFFICE

CERTIFICATE OF CORRECTION

PATENT NO. : 7,959,119 B2
APPLICATION NO. : 12/247661
DATED : June 14, 2011
INVENTOR(S) : Tusting et al.

It is certified that error appears in the above-identified patent and that said Letters Patent is hereby corrected as shown below:

Column 8, Line 48 should read - a retraction ~~refraction~~ system coupled to the plurality of opposing Column 10, Line 5 should read - a retraction ~~refraction~~ system coupled to the plurality of opposing Column 10, Line 28 should read - a retraction ~~refraction~~ system coupled to the plurality of opposing Signed and Sealed this
Third Day of July, 2012

David J. Kappos

David J. Kappos
*Director of the United States Patent and Trademark Office*